United States Patent [19]

Lefavour

[11] 4,388,559

[45] Jun. 14, 1983

[54] BICYCLE LIGHTING SYSTEM

[76] Inventor: David W. Lefavour, 3144 Jacquline Dr., Rockford, Ill. 61101

[21] Appl. No.: 169,650

[22] Filed: Jul. 17, 1980

[51] Int. Cl.[3] ..... H05B 41/34; H05B 35/00

[52] U.S. Cl. ..... 315/78; 307/30; 315/182; 315/200 A; 315/201; 315/205; 315/241 R; 315/250; 340/134

[58] Field of Search ..... 315/78, 178, 182, 200 A, 315/205, 241 R, 250, 253, 201, 312; 340/134; 362/72; 307/30; 363/63

[56] References Cited

U.S. PATENT DOCUMENTS

| | | | |
|---|---|---|---|
| 3,031,599 | 4/1962 | Paschke et al. | 315/201 |
| 3,772,564 | 11/1973 | Leskin | 315/200 A |
| 3,894,281 | 7/1975 | Bloomfield | 315/78 X |
| 4,088,882 | 5/1978 | Lewis | 362/72 X |

FOREIGN PATENT DOCUMENTS

| | | | |
|---|---|---|---|
| 2383577 | 11/1978 | France | 315/200 A |

*Primary Examiner*—Eugene R. LaRoche
*Attorney, Agent, or Firm*—Bernard L. Kleinke

[57] ABSTRACT

A flash tube is provided for producing successive high intensity bursts of light, and a pulse producing device is provided for supplying a train of high voltage pulses for energizing repeatedly the flash tube. An impedance matching arrangement is provided and includes a first unidirectional device which couples the output of the alternator to the pulse producing device for energizing it periodically during half cycles of the alternating current output of the alternator. The arrangement also includes a second unidirectional device which the output of the alternator to an auxiliary lighting device to energize it during alternate half cycles of the alternator. As a result, the alternator supplies lower instantaneous current to both loads at a favorable operating characteristic of the source.

12 Claims, 3 Drawing Figures

BICYCLE LIGHTING SYSTEM

TECHNICAL FIELD

The present invention relates in general to a bicycle lighting system, and it more particularly relates to a bicycle lighting system including a strobe light.

BACKGROUND ART

There have been many different types and kinds of flashing lights for bicycles. For example, reference may be made to the following U.S. Pat. Nos.: 2,283,442; 2,301,250; 2,732,540; and 3,696,334. The foregoing patents disclose flashing bicycle lights which include mechanical switching devices. However, while these flashing lights may be satisfactory for some applications, they are of relatively low intensity and it would be highly desirable to have a high intensity strobe light for producing an attention-attracting signal, as well as a great deal of illumination. For example, reference may be made to an article entitled "A Strobe Flasher for Night Cycling" in *Popular Mechanics,* October, 1976, pages 68–70, which discloses a battery-powered strobe light for bicycles. While such a unit may be satisfactory in that it produces a relatively high intensity flashing light for bicycles, the flashing unit is battery powered, and, therefore, the batteries must be replaced every few hours. Such a situation is not at all satisfactory for many cyclists, especially those who use their bicycles on long trips. Therefore, it would be highly desirable to have a lighting system which produces a high intensity strobe light, and which can be powered by a conventional lightweight alternator driven mechanically by the bicycle as it is propelled along the ground. It should be noted that such a strobe unit must necessarily be light in weight and be powered by conventional lightweight bicycle alternators, since bicycle alternators are generally of a low voltage type.

Therefore, it is the principal object of the present invention to provide a new and improved bicycle lighting system which can be powered by a conventional low-power bicycle alternator, and which is capable of producing high intensity flashing light.

Another object of the present invention is to provide a new and improved fly-back circuit, which is highly efficient and which is relatively inexpensive to manufacture.

DISCLOSURE OF INVENTION

Briefly, the above and further objects of the present invention are realized by providing a flash tube for producing successive high intensity bursts of light and an energy converting device for supplying a train of high voltage pulses for energizing repeatedly the flash tube. An impedance matching arrangement is provided and includes a first unidirectional device which couples the output of the alternator to the energy converting device for energizing it periodically during half cycles of the alternating current output of the alternator. The arrangement also includes a second unidirectional device which couples the output of the alternator to an auxiliary lighting device to energize it during alternate half cycles of the alternator. As a result, the alternator supplies lower instantaneous current to its loads at a favorable operating characteristic of the source.

BRIEF DESCRIPTION OF THE DRAWINGS

The above-mentioned and other objects and features of this invention and the manner of attaining them will become apparent, and the invention itself will be best understood by reference to the following description of an embodiment of the invention taken in conjunction with the accompanying drawings, wherein.

BEST MODE FOR CARRYING OUT THE INVENTION

Figure 1:
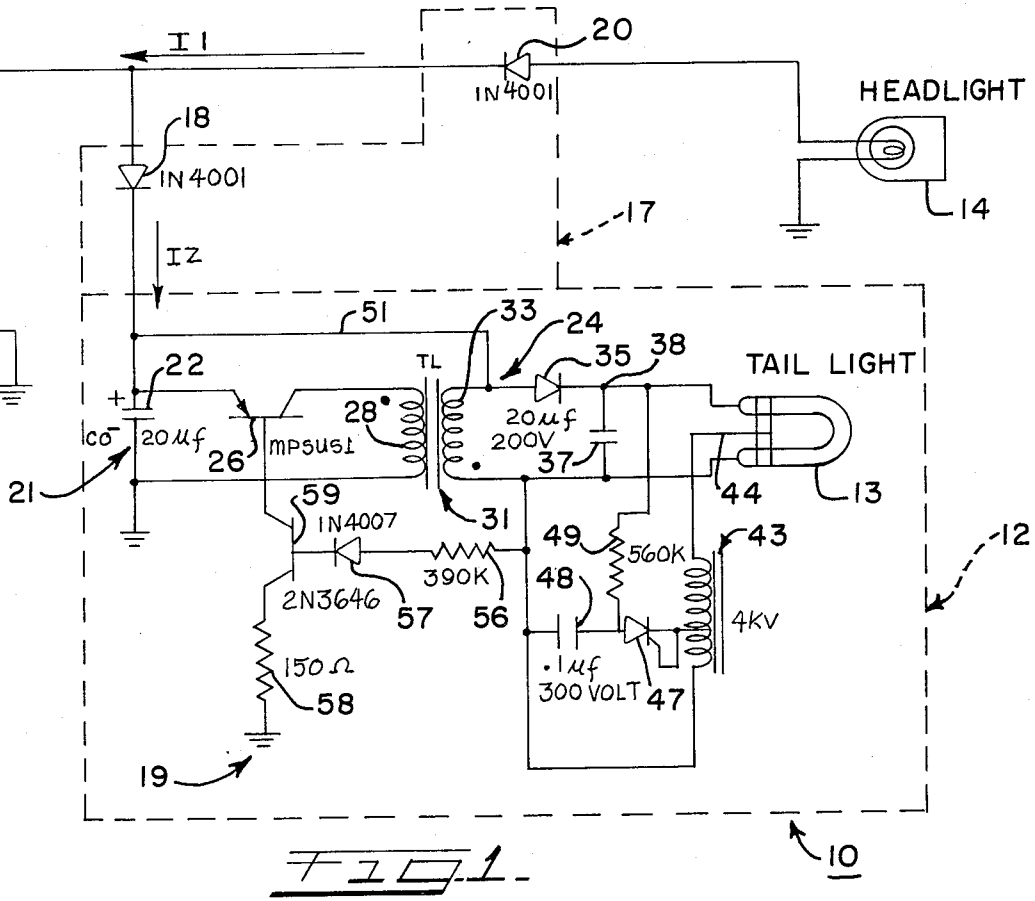
FIG. 1 is a schematic drawing of the bicycle lighting system, which is constructed in accordance with the present invention.

Referring now to FIG. 1 of the drawings, there is shown a bicycle lighting circuit 10, which is constructed in accordance with the present invention, and which is adapted to be mounted on a bicycle with a headlight 14 directed forwardly and a rear strobe light unit 12 having a flash tube 13 directed rearwardly for providing a high intensity flashing light directed rearwardly of the bicycle. An alternator 16 is driven mechanically by the bicycle in a conventional manner for powering the headlight 11 and the rear strobe light unit 12. It should be understood that a colored lens (not shown) may be used in connection with the flash tube 13 to provide a colored light, if desired. Also, the flash tube 13 can also be directed slightly downwardly, since the flash tube 13 does produce a very high intensity light, which might distract the drivers of other vehicles.

Considering now the system 10 in greater detail, the unit 12 includes an impedance matching circuit 17 which comprises a pair of parallel oppositely poled unidirectional devices in the form of diodes 18 and 20 for coupling the power between the alternator 16 and the taillight flash tube 13 of the strobe unit 12 and the headlight 11, respectively. During positive half cycles of the sinusoidal output of the alternator 16, energy is supplied to the strobe unit 12 and during negative half cycles, energy is supplied to the light 11. The unit 12 further includes an energy converting circuit 19 as hereinafter described in greater detail to supply a train of high voltage pulses for energizing repeatedly the flash tube 13. The energy converting circuit 19 includes a filter circuit 21 in the form of a capacitor 22 which is connected between the diode 18 and ground potential for the purpose of shaping the half wave cycle pulses received from the alternator 16 through the diode 18, whereby the capacitor 22 causes a reduced average current demand by the circuit 19 for reducing greatly switching device saturation and driving losses, to increase efficiency as hereinafter described in greater detail in accordance with the present invention.

The energy converting circuit 19 further includes a flyback circuit generally indicated at 24 which responds to the charging of the capacitor 22 to supply the high voltage pulses to the tube 13. The flyback circuit 24 includes a transistor 26 which serves as a switch to enable the capacitor 22 to be discharged to a primary winding 28 of a transformer 31 having a secondary winding 33 for stepping up the voltage for the necessary high voltage pulses for causing the energization of the flash tube 13. A suitably poled diode 35 connects the secondary winding 33 and a capacitor 37, which, in turn, is connected across the tube 13.

An output of an auto-transformer 43 is connected to a trigger terminal 44 of the flash tube 13 to energize it when the capacitor 37 has charged sufficiently. A silicon controlled rectifier 47 serves as a triggering means and is biased into conduction for supplying a triggering signal to the auto-transformer 43, which, in turn, triggers the tube 13. In order to turn ON the silicon controlled rectifier 47, a small capacitor 48 biases it into conduction when the capacitor 48 receives sufficient charge from the large capacitor 37 via a resistor 49. As hereinafter described in greater detail, the circuit 19 causes a series of pulses to be produced for illuminating periodically the tube 13 each time the auto-transformer 43 triggers the tube 13.

In order to charge the capacitor 37, the energy converting circuit 19 causes repeatedly the transistor 26 to be turned ON and OFF alternatingly in response to a positive half wave signal from the open circuit voltage source shown schematically at 61 of the alternator 16 to produce a current flow as the bicycle drives mechanically the alternator 16, whereby the current flows through internal resistance 63 and internal inductance 65 via the diode 18 to charge the capacitor 22. In so doing, energy is transferred repeatedly from the transformer 31 to the capacitor 37. Also, the capacitor 48 is charged until its voltage is sufficiently high to trigger the silicon controlled rectifier 47, thereby triggering the tube 13.

In order to turn ON the transistor 26, once the capacitor 22 is charged to a predetermined small level, a small current begins a flow from the capacitor 22 through a path, which includes the positive terminal of the capacitor 22, a by-pass lead 51, the secondary 33 of the transformer 31, a current-limiting resistor 56, a suitably-poled diode 57, the base-emitter circuit of the transistor 59, and a resistor 58 to ground, whereby the transistor 59 quickly starts to conduct to cause, in turn, the transistor 26 to conduct. As a result, a ramp of current is supplied to the primary winding 28. In so doing, the current flowing in the current path to the base of the transistor 59 increases to drive it further into conduction.

Thus, current continues to build from the capacitor 22 through the emitter-collector circuit of the transistor 26 to the primary winding 28, until the transistor 26 becomes saturated, when the collector current reaches a maximum value defined by the base current and the gain of the transistor 26. At that point, the current is no longer changing and thus the transformer flux stops changing, thereby causing the feed back voltage to decrease abruptly to zero and thus the base current for transistor 26 decreases to zero. As a result, the transistor 26 cuts off and thus limits its collector current. In effect, the transistor 26 is turned OFF abruptly due to feedback around transformer 31, causing the energy stored in the transformer 31 to be transferred to or to "fly back" to the capacitor 37 of the fly-back circuit 24. Since energy continues to be transferred from the alternator to the capacitor 22, the cycle is repeated by causing the transistor 26 to turn ON again for the purpose of transferring more energy to the transformer 31. Thereafter, the stored energy flies back to the capacitor 37. Thus, small bursts of energy are transferred from the step-up transformer 31 to the capacitor 37, until sufficient charge is built up to cause the silicon controlled rectifier 47 to turn ON for triggering the flash tube 13. The cycle is then repeated to build up more sufficient charge on the capacitor 37 for triggering the tube 13 again.

Figure 2A:
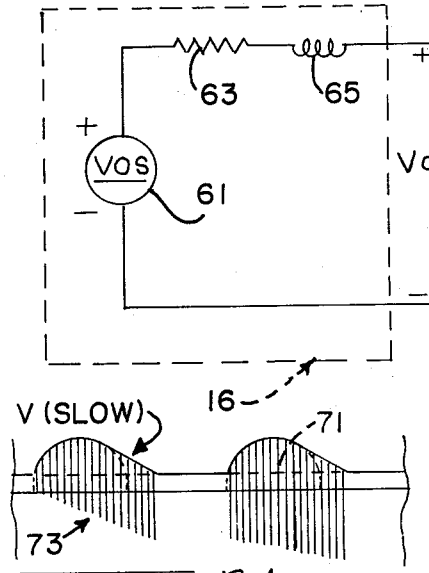
FIGS. 2A and 2B comprise a group of graphs used in understanding the operation of the system of FIG. 1.

Referring now to FIG. 2 of the drawings, considering now the effect of different bicycle speeds on the circuit 19, the voltage across the capacitor 22 is illustrated during slower bicycle speeds in FIG. 2A of the drawings. During slower speeds, the superimposed positive half cycles (shown in dotted lines for illustration purposes) of the alternator voltage delivered via the diode 18 to the capacitor 22, the voltage V (SLOW) across the capacitor 22 is as shown in solid lines. It should be noted that the voltage V (SLOW) starts at an efficiency trade-off voltage level 71 and generally follows the shape of the positive half cycle alternator voltage charging the capacitor 22 and rises to a maximum peak voltage which is the same as the maximum peak voltage of the alternator voltage. This peak voltage is higher (capacitor 22 has a small value) than would otherwise occur if the capacitor 22 had a large value. Small values for the capacitor 22 allow the alternator peak voltage to become higher than would otherwise occur with large values for the capacitor 22. The capacitor voltage gradually discharges from the maximum voltage level toward zero, but is cut off at the efficiency trade-off level and remains at that level until the next positive half cycle of alternator voltage occurs to commence charging the capacitor 22 again to repeat the cycle of operation. The repeated higher frequency flyback pulses or burst of energy between the flyback transformer 31 and the capacitor 37 occur repeatedly many times between the time the voltage V (SLOW) is above the trade-off level 71 as indicated schematically by the series of closely spaced vertical lines indicated at 73.

By preventing the capacitor voltage from completely discharging, the capacitor 22 begins to charge from a level above zero and continues to charge to a level above the maximum level of the alternator output. Thus, the capacitor voltage swings between higher levels, and, therefore, as mentioned previously, there is a reduced average current demand by the circuit 19 for reducing greatly switching device saturation and driving losses. As a result, the efficiency of the circuit 19 is increased. The efficiency is also greatly improved by the fact that the capacitor 22 is not permitted to discharge to zero, since such an operation would otherwise be inefficient. Thus, the efficiency trade-off level 71 is selected to provide a higher voltage level of operation, and yet at the same time, there must be a sufficient time provided to enable a sufficient number of flyback bursts or pulses 73 of energy to be transferred to the capacitor 37 for igniting the tube 13 before the discharging of the capacitor 22 is cut-off at the trade-off level 71. Thus, the efficiency of the operation of the circuit 19 is greatly enhanced at the lower bicycle speeds where conventional alternators ordinarily function less efficiently.

Figure 2B:
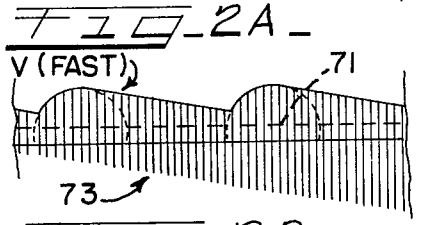

Referring now to FIG. 2B of the drawings, at fast bicycle speeds, the capacitor 22 of the filtering circuit 21 provides less "ripple" than at lower bicycle speeds. In this manner, it should be noted that the capacitor voltage V (FAST) never reaches the efficiency cut-off voltage level 71, and thus the flyback pulses 73 operate continuously, due to the fact that the alternator half cycle voltage wave forms occur again before the capacitor voltage reaches the level 71. Thus, the circuit 19 operates highly efficiently at higher alternator frequencies as well. In actual operation, there is a smooth transition between the slow and fast operations illustrated in FIGS. 2A and 2B. In this regard, as the speed increases, the flyback pulses 73 increase from the intermittent groups as shown in FIG. 2A until they occur continuously as shown in FIG. 2B.

The efficiency trade-off level 71 is accomplished by preventing the transistor 59 from turning ON via its current path to its base. By selecting the proper circuit components, such as the resistor 56, the transistor 59 does not turn ON until sufficient initial current flow is established to the base of the transistor 59.

By employing the impedance matching circuit 17, the load is split between the unit 12 and the headlight 14 for the alternator 16. Thus, in accordance with the present invention, the instantaneous current produced by the alternator is reduced as compared to the situation where both the headlight 14 and the unit 12 were connected directly in parallel. Also, the energy is applied to both the headlight 14 and the unit 12 only half the time. As a result, the alternator 16 operates at its more favorable characteristic as compared to an arrangement where both the headlight 14 and the unit 12 are connected direcly in parallel. With the arrangement of the present invention, the headlight 14 and the flashing taillight 12 are illuminated more brightly as compared to an arrangement where they are connected directly in parallel.

While a particular embodiment of the present invention has been disclosed, it is to be understood that various different modifications are possible and are contemplated within the true spirit and scope of the appended claims. There is no intention, therefore, of limitation as to the exact abstract or disclosure herein presented. Various different component values and equivalent types of semi-conductor devices may be employed as is well known in the art.

I claim:

1. In a lighting system having a source of alternating current adapted to be driven mechanically by a bicycle or the like when it is propelled along the ground and having an incandescent lighting device energizable electrically by the source, strobe lighting apparatus comprising:

a flash tube for producing successive high intensity bursts of light;

energy converting means for supplying a train of high voltage pulses for energizing repeatedly said flast tube; and an impedance matching arrangement including first unidirectional means for coupling the output of the source of said energy converting means for energizing it periodically during half cycles of the alternating current output of the source, and second unidirectional means for coupling the output of the source to the lighting device to energize it during the alternate half cycles of the source.

2. In a lighting system, strobe lighting apparatus according to claim 1, wherein said energy converting means includes filtering means responsive to said first unidirectional means for generating pulses at low speeds of the bicycle and for generating an increased number of pulses at high speeds of the bicycle.

3. In a lighting system, strobe lighting apparatus according to claim 2, wherein said energy converting means includes a flyback circuit including a step-up voltage transformer having its primary winding coupled to said filtering means and having its secondary winding coupled to said flash tube.

4. In a lighting system, strobe lighting apparatus according to claim 3, wherein said filtering means includes capacitor means for storing voltage signals, said energy converting means including triggering means responsive to the output of said filtering means for coupling the output of said filtering means to said primary of said transformer.

5. In a lighting system, strobe lighting apparatus according to claim 4, wherein each one of said unidirectional means includes a diode.

6. In a lighting system, strobe lighting apparatus according to claim 5, wherein said triggering means further includes a second transformer coupled to a triggering input of said flash tube, switching means responsive to said flyback circuit for causing said second transformer to trigger said tube.

7. In a lighting system, strobe lighting apparatus according to claim 4, wherein said energy converting means includes a current path to provide an efficiency cut-off level of operation to enhance efficiency of operation.

8. In a lighting system, strobe lighting apparatus according to claim 7, wherein said capacitor means comprises a capacitor of relatively small capacitance coupled across said primary winding of said transformer when said triggering means is operative.

9. In a lighting system, strobe lighting apparatus according to claim 1, wherein said energy converting means includes transistor switching means responsive to an input signal for generating a ramp signal, said transistor means having base means;

inductance means coupled to the output of said transistor means; and feed back means coupled between said inductance means and said base means for rendering said transistor means non-conductive in responsive to said transistor means becoming unsaturated.

10. In a system, comprising an impedance matching circuit, a small capacity source of alternating current having an internal impedance coupled to said circuit, a pair of first and second loads, first unidirectional means for coupling the output of the source through its internal impedance to the first load to energize it periodically during half cycles of the alternating current output of the source and to match it to the impedance of said first load so that the source supplies lower current to said first load at a favorable operating characteristic of the source, and second unidirectional means for coupling the output of the source through its internal impedance to the second load to energize it during alternate half cycles of the source and to match it to the impedance of said second load so that the source supplies lower current to said second load at a favorable operating characteristic of the source.

11. In a system, the impedance matching arrangement according to claim 10, wherein each one of said unidirectional means includes a diode.

12. In a lighting system having a source of alternating current and including a lighting device, strobe lighting apparatus comprising:

a flash tube for producing successive high intensity bursts of light;

energy converting means for supplying a train of high voltage pulses for energizing repeatedly said flash tube;

an impedance matching arrangement including first unidirectional means for coupling the output of the source to said energy converting means for energizing it periodically during half cycles of the alternating current output of the source, and second unidirectional means for coupling the output of the source to the lighting device to energize it during alternate half cycles of the source;

said energy converting means including a flyback circuit including a step-up voltage transformer having its primary winding coupled to said flash tube;

said capacitor means comprising a capacitor of relatively small capacitance coupled across said primary winding of said transformer when said second switching means is operative;

said energy converting means including a current path to provide an efficiency cut-off level of operation to enhance efficiency of operation, for preventing said capacitor from discharging substantially completely.

* * * * *